US010793393B2

(12) United States Patent
Müller et al.

(10) Patent No.: US 10,793,393 B2
(45) Date of Patent: Oct. 6, 2020

(54) FIBROUS WEB WINDING AND UNWINDING REEL

(71) Applicant: Voith Patent GmbH, Heidenheim (DE)

(72) Inventors: Malte Müller, Hermaringen (DE); Matthias Wohlfahrt, Heidenheim (DE); Ewald Wetschenbacher, Zöbingen (DE); Ralf-Harald Preising, Westerstetten (DE)

(73) Assignee: Voith Patent GmbH, Heidenheim (DE)

( * ) Notice: Subject to any disclaimer, the term of this patent is extended or adjusted under 35 U.S.C. 154(b) by 207 days.

(21) Appl. No.: 15/983,728

(22) Filed: May 18, 2018

(65) Prior Publication Data

US 2018/0265326 A1 Sep. 20, 2018

Related U.S. Application Data

(63) Continuation of application No. PCT/EP2016/077799, filed on Nov. 16, 2016.

(30) Foreign Application Priority Data

Nov. 20, 2015 (DE) ..... 10 2015 222 927

(51) Int. Cl.
*B65H 75/28* (2006.01)
*B65H 19/28* (2006.01)
*B65H 75/10* (2006.01)

(52) U.S. Cl.
CPC ..... *B65H 75/28* (2013.01); *B65H 19/28* (2013.01); *B65H 75/10* (2013.01);
(Continued)

(58) Field of Classification Search
CPC ..... B65H 75/10; B65H 75/28; B65H 19/28; B65H 2401/13; B65H 2401/113
See application file for complete search history.

(56) References Cited

U.S. PATENT DOCUMENTS 3,813,026 A * 5/1974 Biancamaria ..... B31C 3/00 229/4.5
4,287,244 A * 9/1981 McMahon, Jr. ..... B31C 13/00 101/483

(Continued)

FOREIGN PATENT DOCUMENTS

DE 100 85 234 T1 10/2002
DE 20 2014 010 451 U1 9/2015

(Continued)

OTHER PUBLICATIONS

Notice of Transmission of the International Research Report and the Written Notice Issued the International Searching Authority or Declaration dated Feb. 6, 2017 for International Application No. PCT/EP2016/077799 (11 pages).

(Continued)

*Primary Examiner* — Sang K Kim
(74) *Attorney, Agent, or Firm* — Taylor IP, P.C.

(57) ABSTRACT

The invention relates to a spool for winding a fibrous web, the lateral surface of which is formed by a coated spool core. The aim of the invention is to improve the winding quality by the fact that the outer lateral surface is formed by a plurality of separate coatings which are arranged axially next to one another, of which at least two adjacent coatings are made of different materials.

15 Claims, 1 Drawing Sheet

(52) U.S. Cl.
CPC .... *B65H 2401/113* (2013.01); *B65H 2401/13* (2013.01); *B65H 2405/45* (2013.01); *B65H 2701/515* (2013.01)

(56) References Cited

U.S. PATENT DOCUMENTS

| | | | | |
|---|---|---|---|---|
| 4,338,147 | A | 7/1982 | Bäckström et al. | |
| 2011/0057069 | A1* | 3/2011 | Hernandez | B31C 3/00 242/610.1 |

FOREIGN PATENT DOCUMENTS

| | | | |
|---|---|---|---|
| EP | 1 310 445 | A2 | 5/2003 |
| JP | 2002-187109 | A | 7/2002 |
| WO | 2007/088246 | A1 | 8/2007 |

OTHER PUBLICATIONS

German Office Action dated Jul. 18, 2016 for German Application No. 10 2015 222 927.0 (5 pages).

* cited by examiner

FIBROUS WEB WINDING AND UNWINDING REEL

CROSS REFERENCE TO RELATED APPLICATIONS

This is a continuation of PCT application No. PCT/EP2016/077799, entitled "SPOOL", filed Nov. 16, 2016, which is incorporated herein by reference.

BACKGROUND OF THE INVENTION

1. Field of the Invention

The present invention relates to a reel for winding and unwinding a fibrous web, including a reel core and a coating that forms the outside surface of the reel.

2. Description of the Related Art

In the paper industry, fibrous webs are wound onto a reel and stored on a reel. The problem arises herein that the web ends move freely especially during reel change-over, and as a result can tear away and possibly cause damage.

DE 100 85 234 T1 describes a method and a device for a reel change. The fibrous web that is to be wound onto a roll is moved by the torque of a reel drum and a gap load. During a reel change, a new reel above the reel drum is brought into contact with the fibrous web.

To avoid a severe impact when closing the gap, the reels are predominantly covered with a rubber layer.

To secure the web ends onto the empty reel, the web ends are covered with an adhesive strip or with a viscous adhesive.

A failure during the transfer process from the full to the empty reel, causes the entire fibrous web or a strip thereof to be discharged into the pulper in the machine basement. To reliably ensure this, the fibrous web on the reel drum is guided to a doctor blade.

What is needed in the art is to improve winding and unwinding of the fibrous web, as well as the quality of the wound roll.

SUMMARY OF THE INVENTION

The present invention provides a reel utilized during the winding and unwinding of fibrous web. The invention in one form is directed to an outer lateral surface formed by a plurality of separate coatings arranged axially adjacent to one another, of which at least two adjacent coatings consist of different materials. Thus allowing adaptation of the coating to the requirements of the winding process.

As there are different requirements, particularly in regard to the web edges and the tip of the web, it may be advantageous if the outside surface of the reel is formed by three coatings that are arranged axially adjacent to one another.

The axial length of a coating, or specifically of the center coating should be between 10 and 200 cm, preferably between 30 and 100 cm.

It may be advantageous if the axially centered coating has a smoother surface than the outer coatings, resulting in higher adhesion with the tip of the fibrous web at the start of winding.

Additionally, due to the smoother coating, the generally glued on tip can be removed easily from the reel during unwinding from the reel.

The roughness, $R_a$, of the center coating can be less than 0.2 μm, whereas on the axially outer coatings, the roughness, $R_a$, can be 0.6 μm or higher.

In another embodiment, the axially centered coating should consist partially to entirely of polytetrafluoroethylene ('PTFE').

In another embodiment a fabric tape is coated with PTFE and forms the coating.

It may be advantageous if the axially centered coating has higher elasticity than the axially outer coatings.

Through greater compressibility in the radial direction, the tip of the fibrous web can press itself into the coating of the reel at the beginning of the winding cycle preventing the tip of the fibrous web from leaving an image in the subsequently wound fibrous web.

The invention in another form is directed to an axially centered coating supported directly on the reel core.

The invention in another form is directed to an axially centered coating which is embedded into a coating extending over the entire axial extension of the reel core.

If the requirements upon the coating are too demanding, it may be advantageous to distribute the requirements between several separate layers that are positioned radially above one another.

In the embodiment of two radial layers of a coating that are positioned on top of one another, the radially outer coating provides a smooth outside surface and the layer positioned radially below it provides the necessary compressibility and elasticity.

The invention in another form is directed to an axially centered coating with an outside diameter of 0.05 to 0.25 mm greater than the outer coatings. The larger diameter in the axial center of the reel provides a reliable and intensive gap formation at the start of winding, and increased pressure at the tip of the fibrous web against the reel.

In another embodiment an axially centered coating is applied onto a coating extending over the entire axial extension of the reel core.

In the interest of low production costs and a relatively high wear and tear resistance, the axially outer coatings should consist of rubber or polyurethane ("PU").

The application of the center coating can be facilitated if the coating is in the embodiment of a fabric tape.

BRIEF DESCRIPTION OF THE DRAWINGS

The above-mentioned and other features and advantages of this invention, and the manner of attaining them, will become more apparent and the invention will be better understood by reference to the following description of (an) embodiment(s) of the invention taken in conjunction with the accompanying drawing(s), wherein.

Figure 1:
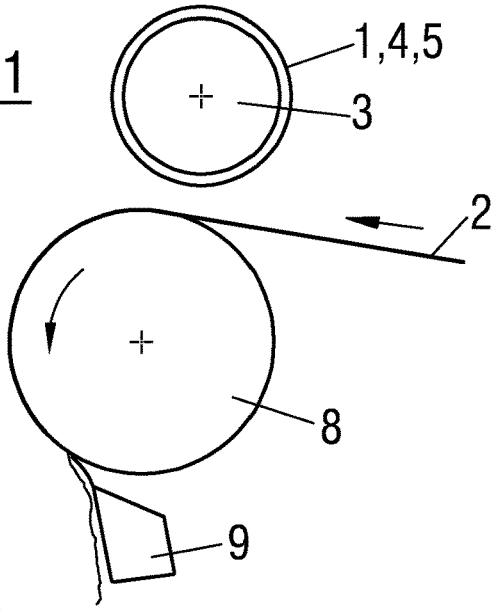
FIG. 1 illustrates a schematic cross section through a winder when purging fibrous web 2 to the pulper in the machine basement.

Corresponding reference characters indicate*j corresponding parts throughout the several views. The exemplification(s) set out herein illustrate(s) (one) embodiment(s) of the invention (, in one form,) and such exemplification(s) (is)(are) not to be construed as limiting the scope of the invention in any manner.*

DETAILED DESCRIPTION OF THE INVENTION

Figure 2:
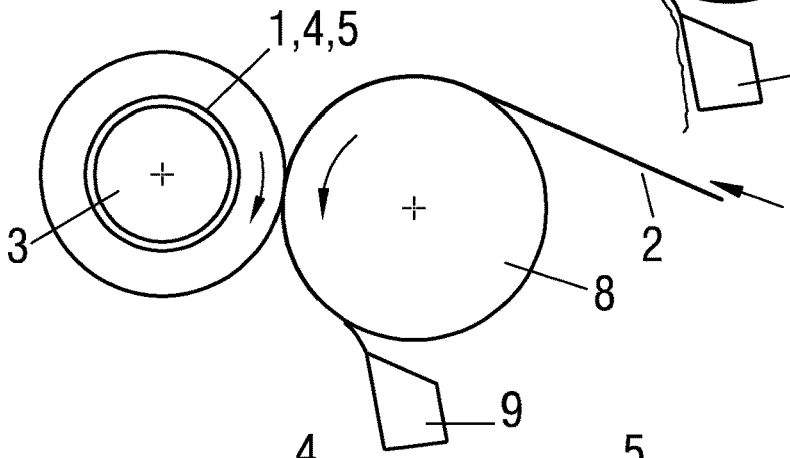
FIG. 2 illustrates a schematic cross section through a winder when winding fibrous web 2 to an embodiment.

Fibrous web 2 is wound in machines of this type onto a reel 1 in the embodiment of a reel core 3 consisting of steel and in particular, having rubber or plastic coating. During this winding process illustrated in FIG. 2, reel 1 is driven at its surface by a reel drum 8.

The two shafts of reel 1 are herein rotatably mounted in one arm respectively of a transfer unit. Prior to reel 1 being fully wound, an empty reel 1 is guided over other arms and brought up to full machine speed by reel drum 8.

To change out the reel, empty reel 1 is placed against reel drum 8 and fibrous web 2, simultaneously removing fully wound reel 1 from reel drum 8.

Fibrous web 2 can herein be severed in different ways. Typically, the separation and the placement of fibrous web 2 on empty reel 1 occurs with the assistance of an air or water jet.

Fully wound reel 1 must be subsequently slowed down and transported into a final position.

Fully wound reel 1 may be subsequently lifted from the machine by a crane.

During changeover of the reel or in the event of a web break of fibrous web 2, it may become necessary to direct fibrous web 2 or a strip thereof into the machine cellar and there after into a pulper for reprocessing.

FIG. 1 illustrates the fibrous web 2 being guided through the open winding gap between empty reel 1 and reel drum 8 to a doctor blade 9 of reel drum 8.

Doctor blade 9 separates fibrous web 2 or the relevant strip from the outside surface of reel drum 8 and then guides fibrous web 2 downward into the machine cellar.

This arrangement is simple, strong, and functionally reliable.

To improve the winding process, in particular to improve the start of the winding process and unwinding of the leading edge of the fibrous web, the outside surface of reel 1 is formed by two alternating coatings 4, 5 which are arranged circumferentially axially adjacent to one another in circumferential direction. Viewed in axial direction, center coating 5 extends in axial direction between 30 and 100 cm.

At the start of the winding process, a tip of fibrous web 2 is generally located in the center of the web is brought into contact with empty reel 1 and wound up, whereby the web width increases continuously.

To improve adhesion on reel 1, the tip of fibrous web 2 may be provided with an adhesive.

The adhesive presents problems when the tip is separated from the reel during unwinding of fibrous web 2.

To allow for separation of the tip from the reel, an axially centered coating 5 includes a PTFE adhesive tape which is embedded into the axial extending coating 4 which consists of a hard PU and rubber. The continuous coating 4 also forms the two axially lateral coatings 4 of the outside surface.

The PTFE adhesive tape may be wound onto an axially centered recess in continuous coating 4. Due to the comparatively smoother surface of the PTFE adhesive tape than that of lateral coatings 4, the tip of fibrous web 2 adheres very reliably to the surface of reel 1 at the start of winding.

Additionally, the often glued on tip of fibrous web 2 may be separated easily from reel 1 when unwinding.

Figure 7:
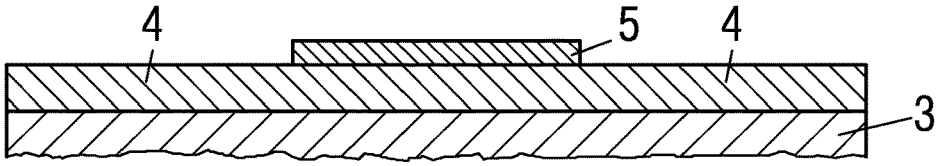

In another embodiment, an axially centered coating 5 of a PTFE adhesive tape, as illustrated in FIG. 7 may be applied with adhesive onto an axially continuous coating 4 consisting of hard PU or rubber. In the embodiment, the axially centered coating 5 protrudes beyond adjacent coatings 4 by 0.05 to 0.25 mm resulting in no impact to the quality of the wound roll.

Figure 5:
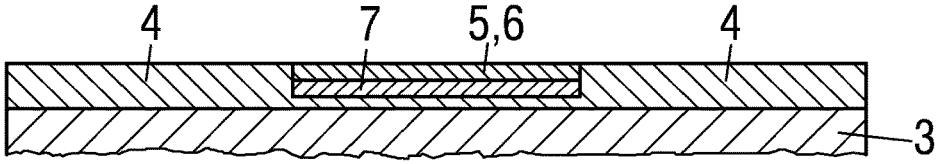

In another embodiment, an axially centered coating 5 as illustrated in FIG. 5 is formed by two layers 6, 7 which are placed on top of one another. Radially outer layer 6 is a smooth PTFE adhesive tape and radially inside layer 7 consists of a PU tape with a silicone coating.

The radial inside layer 7 is considerably more elastic than layer 6 and axial continuous coating 4 of reel core 3.

Due to the increased compressibility of center coating 5, the tip of fibrous web 2 can thus press itself more easily into reel 1 such that the tip does not leave an imprint into wound fibrous web 2, thus leading to markings through wound fibrous web 2.

Figure 3:
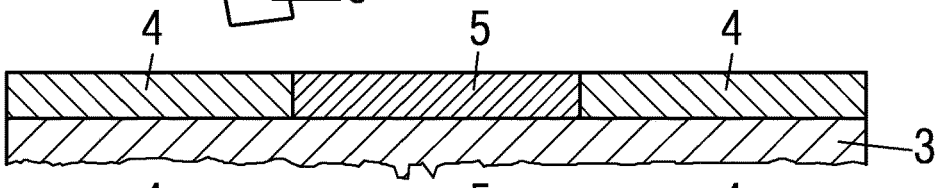
FIGS. 3-7 cross section through reels 1 of various embodiments.
Figure 4:
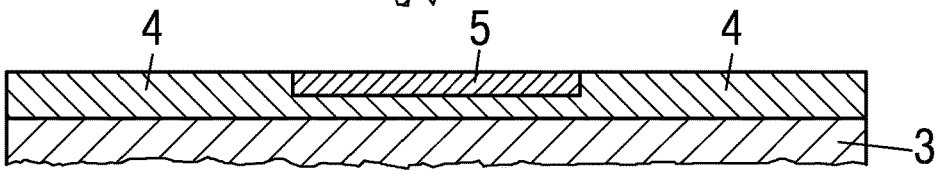

In another embodiment, a center coating 5 as illustrated in FIG. 3 is applied directly onto reel core 3. The center coating 5 may be more elastic with a smoother surface than the two lateral coatings 4 or only have a smoother surface than the two lateral coatings.

Figure 6:
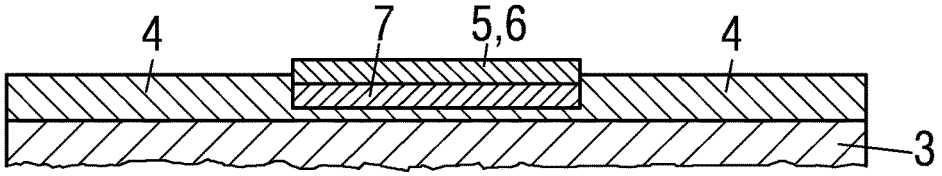

Reel 1 as illustrated in FIG. 6, and in FIG. 7, the axially centered coating 5 has a larger outside diameter than axial outer coatings 4. Due to the larger diameter, a reliable and intensive gap formation is created with reel drum 8 for the purpose of increasing the press force at the tip of fibrous web 2 against reel 1 during start of the winding process.

To prevent imprints in fibrous web 2, the transition from the smaller diameter of lateral coatings 4 to the larger diameter of centered coating 5 should be gradual. Additionally, the diameter of centered coating 5 is 0.1 to 2 mm larger than the diameter of lateral coatings 4.

The thickness of centered coating 5 that is embedded into axially continuous coating 4 is between 0.1 and 5 mm, in particular between 0.1 and 2.5 mm.

The overall thickness of coatings 4, 5 on reel core 3 is 5-20 mm.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1. Reel
2. Fibrous Web
3. Reel Core
4. Coating
5. Coating
6. Coating
7. Coating
8. Reel Drum
9. Doctor Blade

What is claimed is:

1. A reel for winding a fibrous web, comprising:

a reel core; and a plurality of coatings that form an outer surface of the reel, the plurality of coatings including a plurality of separate coatings which are arranged axially adjacent to one another, at least two adjacent of the plurality of coatings consisting of different materials, one of the axially adjacent coatings being at least partially of polytetrafluoroethylene ("PTFE"), the other axially adjacent coating being an axially centered coating, one of the PTFE coating and the axially centered coating having a larger outer diameter than the other.

2. The reel according to claim 1, wherein the plurality of separate coatings include three coatings that are arranged axially adjacent to one another.

3. The reel according to claim 1, wherein the axially centered coating has a surface roughness Ra of less than 0.2 μm, and a distally located coating with a surface roughness Ra greater than 0.6 μm.

4. The reel according to claim 3, wherein the axially centered coating has a higher elasticity than the distally located coating.

5. The reel according to claim 3, wherein the axially centered coating has an outside diameter of between 0.05 to 0.25 mm greater than the distally located coating.

6. The reel according claim 3, wherein the axially centered coating is supported directly on the reel core.

7. The reel according to claim 3, wherein the axially centered coating is embedded into at least one of the plurality of coatings extending over an entire axial extension of the reel core.

8. The reel according to claim 3, wherein the axially centered coating is applied to at least one of the plurality of coatings extending over an entire axial extension of the reel core.

9. The reel according to claim 3, wherein the axially centered coating is formed by at least two layers that are positioned radially on top of one another.

10. The reel according to claim 9, wherein the axially centered coating includes a radial inside layer and a radial outer layer, the radial inside layer having a higher elasticity than the radial outer layer.

11. The reel according to claim 3, wherein the axially centered coating has an axial length between 10 and 200 cm.

12. The reel according to claim 11, wherein the axially centered coating has an axial length between 30 and 100 cm.

13. The reel according to claim 1, wherein at least one of the plurality of coatings consists at least partially of polytetrafluoroethylene ("PTFE").

14. The reel according to claim 1, wherein at least one of the plurality of coatings is formed by a fabric tape.

15. The reel according to claim 1, wherein the plurality of separate coatings consists of rubber or polyurethane ("PU").

* * * * *